US007752988B2

(12) United States Patent
Axford

(10) Patent No.: US 7,752,988 B2
(45) Date of Patent: Jul. 13, 2010

(54) TOWING DEVICE

(75) Inventor: Nigel Axford, Sherborne (GB)

(73) Assignee: Thales Holding UK PLC (GB)

( * ) Notice: Subject to any disclaimer, the term of this patent is extended or adjusted under 35 U.S.C. 154(b) by 0 days.

(21) Appl. No.: 11/570,235

(22) PCT Filed: Jun. 2, 2005

(86) PCT No.: PCT/EP2005/052545

§ 371 (c)(1),
(2), (4) Date: Dec. 31, 2007

(87) PCT Pub. No.: WO2005/120942

PCT Pub. Date: Dec. 22, 2005

(65) Prior Publication Data

US 2008/0196651 A1 Aug. 21, 2008

(30) Foreign Application Priority Data

Jun. 7, 2004 (GB) ..... 0412677.7

(51) Int. Cl.
*B63G 8/14* (2006.01)

(52) U.S. Cl. ..... 114/245; 114/330

(58) Field of Classification Search ..... 114/244, 114/245, 315, 330, 331, 332
See application file for complete search history.

(56) References Cited

U.S. PATENT DOCUMENTS 3,089,453 A 5/1963 Buck et al.
3,107,640 A * 10/1963 Lepine et al. ..... 114/245
3,688,730 A * 9/1972 Ortlieb et al. ..... 114/245
3,931,777 A * 1/1976 Colgan ..... 114/245
4,220,109 A 9/1980 Cholet
4,463,701 A 8/1984 Pickett et al.
4,549,499 A * 10/1985 Huffhines et al. ..... 114/244
5,000,110 A 3/1991 Moore et al.
5,178,090 A * 1/1993 Carter ..... 114/315
6,561,116 B2 * 5/2003 Linjawi ..... 114/315
6,575,114 B2 * 6/2003 Sandler et al. ..... 114/315

FOREIGN PATENT DOCUMENTS

GB 2 244 249 A 11/1991
GB 2 309 952 A 8/1997

* cited by examiner

*Primary Examiner*—Lars A Olson
(74) *Attorney, Agent, or Firm*—Lowe Hauptman Ham & Berner, LLP

(57) ABSTRACT

An apparatus for towing behind an underwater vehicle has a body and a yoke pivotally connected to the body at a pivot point and having a tether remote from the pivot point by which the apparatus us towed. The yoke has wings which generate a resultant force on the body when the apparatus is towed. By varying the orientation of the yoke relative to the body, the magnitude of the resultant force may be varied. The resultant force tends to reduce the displacement of the tether relative to the pivot point in at least one plane, thereby generating a force to counter the buoyancy of the apparatus, and so stabilize the apparatus when it is being towed.

16 Claims, 1 Drawing Sheet

TOWING DEVICE

CROSS-REFERENCE TO RELATED APPLICATIONS

The present application is based on International Application No. PCT/EP2005/052545, filed on Jun. 2, 2005, which in turn corresponds to United Kingdom Application No. 04 12677.7, filed Jun. 7, 2004, and priority is hereby claimed under 35 USC §119 based on these applications. Each of these applications are hereby incorporated by reference in their entirety into the present application.

BACKGROUND OF THE INVENTION

Field of the Invention

The present invention relates to an apparatus for towing behind an underwater vehicle, providing improved diving and towing stability.

It is known to diving and stability of a buoyant underwater body using a yoke, which is attached to the body approximately at its centre. This helps to provide stable towing.

However, the known towing devices do not counteract forces on the towed body that tend to destabilize the towing operation. In particular, they are not designed to counteract positive buoyancy of towed objects.

SUMMARY OF THE INVENTION

The present invention relates to an apparatus which has improved stability during underwater towing, and in particular which has means which help to oppose destabilising forces acting on the towed body. At its most general the present invention proposes that the connection of the towing cable or other link is via a pivotable device with a wing generating a force on the body.

In a first aspect of the invention, there may be provided an apparatus for towing behind an underwater vehicle, comprising

- a device pivotably connectable to the body at least one pivot point, having a towing point remote from said pivot point,
- wherein the device comprises at least one wing which is adapted to generate a resultant force on the body, the magnitude of which is variable in dependence on the orientation of the device relative to the body.

When the apparatus is being towed by a vehicle, the relative water flow causes the wing to generate a force (the resultant force). In use this force tends to reduce the displacement of the tow point from the pivot point, in at least one plane. The resultant force on the body has two components, a force perpendicular to the direction of movement of the body and a drag force due to the wing parallel to the direction of movement of the body. As the angle of the wing changes relative to the body, these components change, varying both the direction and magnitude of the resultant force.

The displacement may be vertical and/or lateral displacement. The wing may reduce the vertical and/or lateral element of this displacement. In other words, the forces acting on the wing tend to improve the alignment of the pivot point with the vehicle and/or the tow point in the direction of movement, but they need not act to bring them into perfect alignment.

Since the orientation magnitude of the resultant force is variable depending of the orientation of the device relative to the body, the stabilisation is self-regulating. Altering the orientation of the device relative to the body alters the angle of attack of the lift-providing surface on the wing. For instance, where the displacement of the pivot point from the axis of vehicle movement (and hence from the tow point) is high, the wing will present a high angle of attack which will cause a resultant force tending to oppose this displacement. However, as the pivot point is brought into line behind the tow point the angle of attack will be reduced (i.e., the surface of the wing will be presented to the water flow at a reduced angle) and the lift force will also be reduced.

The size of the lift force will also be affected by the area of the lift surface. Preferably, the wing has a substantially planar surface which acts as the lift surface. More preferably, the wing is a plane.

The direction of the lift force may also be switchable in dependence on the orientation of the device relative to the body. The direction in which the lift force is applied will depend on whether the angle of attack of the wing's lift surface is positive or negative.

For example, and in respect of preferred embodiments of the invention, if the body is raised relative to the axis of movement of the vehicle and hence to the tow point, then the towing device and the wing will be orientated relative to the body such that the lift force tends to depress the body. However, if the pivot point is lower than the tow point, then the towing device and the wing will be orientated relative to the body such that the lift force tends to raise the body.

Preferably, the wing is adapted to generate a force which tends to control vertical displacement of the pivot point from the tow point at any particular speed.

For example, the wings may be arranged such that if the towing device is orientated with first and second connection means located on a horizontal axis, then the wings extend substantially horizontally.

This arrangement is particularly desirable when the towed body tends to rise or sink relative to the direction of movement. Hence, the arrangement is particularly suitable for towed bodies with positive or negative buoyancy, and most preferably positive buoyancy.

Alternatively, the wings may be adapted to generate a lift force which tends to reduce lateral displacement of the pivot point from the axis of movement of the towing vehicle. For example, the wings may be arranged such that if the towing device is orientated with first and second connection means located on a horizontal axis, then the wings extend substantially vertically.

In a preferred embodiment, the towing device has two arms which are adapted to extend on either side of the towed body, wherein each arm is connectable to the body at a pivot point. One such arrangement is a yoke. It may be preferred that the two arms of the towing device or yoke are connected to a shaft, which is adapted to pass through a corresponding aperture in the towed body so as to allow the towing device or yoke to pivot about the axis of the shaft. Alternatively, each arm may be connected to a separate region of the towed body.

Preferably, the pivot points lie on an axis which passes through the body's centre of gravity or centre of buoyancy. This helps to stabilize the body, since a lift force applied to the pivot point acts in direct opposition to the negative or positive buoyancy of the body, and does not tend to tilt the body about the pivot point.

The term "pivot point" is intended to refer to any or all points of connection between the towing device and the towed body, where said connection allows the towed body to pivot relative to the device. For example, if the towing device comprises a shaft extending between two arms, which shaft passes through a corresponding aperture in the towed body, then all parts of the body in contact with the shaft are considered to be a pivot point.

Where the towing device comprises two arms, then it may be preferred that each arm bears a wing or wings. This may help to avoid rotational forces on the towed body.

The provision of an apparatus according to the present invention may result in some embodiments in improved stability, reduced drag and/or improved diving characteristics of the towed body.

In some embodiments the apparatus of the present invention is to allow a buoyant body to be depressed sufficiently to allow it to be towed to a depth underwater with good stability, and at high speeds. The vertical displacement of the buoyant body relative to the dive angle of the vehicle results in the wing presenting an oblique angle to the relative water flow, and this results in a lift force which tends to push the body downwards, opposing its buoyancy. The lift force will increase with the speed of movement.

It may be preferred that the towed body has a stabilising tail, for example a tail which is arranged to resist pivoting of the body about its pivot point. Preferably the tail extends rearwardly.

The design can in addition incorporate a control system such as means for actuating the wings. However, in preferred embodiments the apparatus does not require an additional control system (e.g., a system which is electronically or externally controlled). Therefore, in preferred embodiments, the apparatus does not have such a system.

Still other advantages of embodiments according to the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

An embodiment of the invention will now be described by way of example, with reference to the accompanying drawings, which are intended to illustrate but not to limit the invention, and in which.

DETAILED DESCRIPTION OF THE EMBODIMENTS

Figure 1:
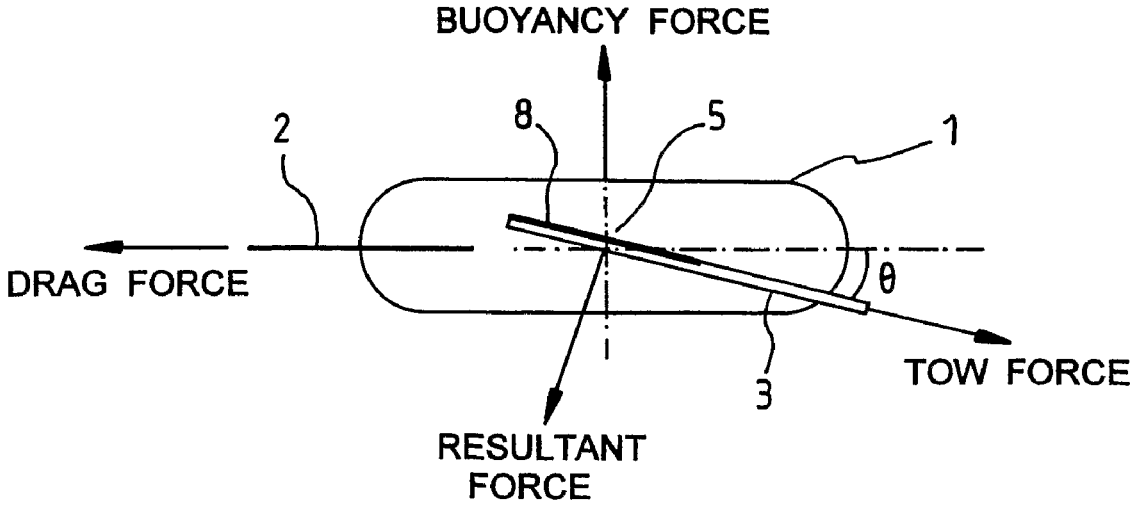
FIG. 1 shows a side view of a towed body and towing device of the embodiment.
Figure 2:
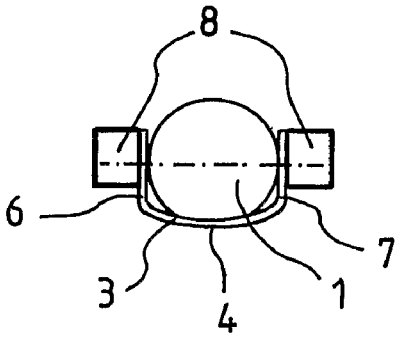
FIG. 2 shows a front view of a towed body and towing device of the embodiment.

FIGS. 1 and 2 show a buoyant body 1 having a stabilising tail 2 which extends from the rear of the body. The body 1 is a sealed watertight body, which may, for example contain electrical components for permitting signalling to or from the body 1.

The buoyant body 1 is pivotally mounted to a U shaped yoke 3 having a tether point 4 at the bottom of the U. The yoke 3 is freely pivotable about its connection point 5 at the approximate centre of the body 1. A cable or other link (not shown) is connected to the tether point and extends to a powered underwater vehicle (not shown) which is driven to tow the body 1 in the water.

The yoke has two arms 6 and 7. Each arm has a dive plane 8 extending laterally relative to the buoy. When the yoke is horizontal, then the dive planes 8 also extend horizontally.

In use, the apparatus will be towed from its tether point 4. FIG. 1 shows the forces which will be acting on the dive plane when the direction of tow is forwards (i.e., from left to right in FIG. 1) The buoyancy of the body 1 caused it to be raised relative to the vehicle, and as a result the yoke 3 has pivoted about the connection point 5 to the body 1 and about its tether 4. The yoke defines an angle θ relative to the direction of movement of the vehicle and hence to the relative water flow. The dive planes 8 are presented to the water flow at the same angle θ. This results in a resultant force exerted on the dive plane 8, which tends to depress the body.

As the forward tow speed increases the buoyant body is depressed by the resultant force. The size of the force is dependent on the area of the dive planes 8, the angle of inclination θ to water flow and the speed of the flow over them.

The resultant force on the buoyant body is the vector summation of all of the forces acting thereon (shown in FIG. 1). In particular, the forces are the tow force, the buoyancy force due to the inherent buoyancy of the body 1, the drag force due to the drag of the body 1 in the water, and the resultant force due to the dive planes. Since the yoke 3 is attached to the body at its centre of buoyancy, all these forces act at a common point. As a result, the tow force and the resultant force do not exert a pivoting force on the body 1, and the body 1 is kept stable by the action of the stabilising tail 2.

As the body 1 descends closer to the depth as the tether point 4, the angle of inclination of the dive planes 8 to the water flow decreases and the lift force is reduced. At any given speed of the buoyant body 1 an equilibrium point is reached for all the forces in the system.

It will be readily seen by one of ordinary skill in the art that embodiments according to the present invention fulfill many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. An apparatus for towing behind an underwater vehicle having a body, comprising:

a U-shaped device having a towing point at the bottom of the U, said body being pivotally mounted to said U-shaped device at a pivot point remote from said towing point, said U-shaped device comprising at least one wing fixed relative to said towing point, said wing being configured to generate a resultant force on the body, the orientation and magnitude of which is variable in dependence on the orientation of said U-shaped device relative of said body, wherein the towing device has two arms which are adapted to extend on either side of the towed body, wherein the arms have connecting means for pivotably connecting the towing device to the body.

2. The apparatus of claim 1, wherein the towed body has positive buoyancy.

3. The apparatus of claim 2, wherein the wing is adapted to generate a resultant force which tends to oppose vertical displacement of the pivot point from the towing point.

4. The apparatus of claim 3, wherein the towed body has a stabilizing tail.

5. The towing device according to claim 2, wherein the wing has a planar surface.

6. The apparatus of claim 1, wherein the wing is adapted to generate a resultant force which tends to oppose vertical displacement of the pivot point from the towing point.

7. The towing device of claim 6, wherein the device comprises the wing extending from each arm.

8. The apparatus according to claim 7, wherein the connecting means for pivotably connecting the towing device to the body lie on an axis which runs through a center of gravity or center of buoyancy of the body.

9. The towing device according to claim 7, wherein the wing has a planar surface.

10. The towing device according to claim 6, wherein the wing has a planar surface.

11. The apparatus according to claim 1, wherein the connecting means for pivotably connecting the towing device to the body lie on an axis which runs through a center of gravity or center of buoyancy of the body.

12. The apparatus of claim 11, wherein the towed body has a stabilizing tail.

13. The towing device according to claim 11, wherein the wing has a planar surface.

14. The towing device according to claim 1, wherein the wing has a planar surface.

15. The apparatus of claim 14, wherein the towed body has a stabilizing tail.

16. The towing device according to claim 1, wherein the wing has a planar surface.

* * * * *